United States Patent [19]

Selbach et al.

[11] Patent Number: 4,700,394

[45] Date of Patent: Oct. 13, 1987

[54] METHOD OF RECOGNIZING SPEECH PAUSES

[75] Inventors: Bernd Selbach, Eckental; Peter Vary, Herzogenaurach-Niederndorf, both of Fed. Rep. of Germany

[73] Assignee: U.S. Philips Corporation, New York, N.Y.

[21] Appl. No.: 552,998

[22] Filed: Nov. 17, 1983

[30] Foreign Application Priority Data

Nov. 23, 1982 [DE] Fed. Rep. of Germany ..... 3243231

[51] Int. Cl.[4] ..... G10L 5/00

[52] U.S. Cl. ..... 381/46

[58] Field of Search ..... 381/46, 47

[56] References Cited

U.S. PATENT DOCUMENTS

| | | | |
|---|---|---|---|
| 4,025,721 | 5/1977 | Graupe et al. | 381/47 |
| 4,028,496 | 6/1977 | LaMarche et al. | 381/46 |
| 4,052,568 | 10/1977 | Jankowski | 381/46 |
| 4,531,228 | 7/1985 | Noso et al. | 381/46 |
| 4,597,098 | 6/1986 | Noso et al. | 381/46 |

*Primary Examiner*—E. S. Matt Kemeny

*Attorney, Agent, or Firm*—Thomas A. Briody; Jack Oisher; William J. Streeter

[57] ABSTRACT

Method of recognizing pauses in a speech signal when a slowly varying noise signal is superposed on the speech signal. For the purpose of pause recognition so-called short-time mean values connected with a clock pulse are continuously determined from the samples of the disturbed speech signal, which short time mean values are a measure of the average power of approximately 100 ms long sections of the disturbed speech signals. The sequence of these short-time mean values is then smoothed by linear filtration or by means of a median filter. In parallel with the smoothing operation an estimate for the noise signal power averaged over a few seconds is taken from the sequence of short-time mean values. If the smoothed short-time mean value is once or several times less than a threshold which is proportional to the above-mentioned estimate, then it is decided that there is a speech pause.

8 Claims, 4 Drawing Figures

METHOD OF RECOGNIZING SPEECH PAUSES

BACKGROUND OF THE INVENTION

The invention relates to a method of recognizing speech pauses in a speech signal which may have noise signals superposed on them.

Methods of this type are, for example, the prerequisite for the suppression of noise signals when telephone calls are made from an environment with acoustic disturbances. During the speech pause characteristic parameters of the noise signal are measured and employed to filter the noise before transmission substantially completely from the signal to be transmitted, using adaptive filters.

DE-AS No. 24 55 477 and corresponding to UK Patent Specification No. 1 515 937, column 10 discloses an arrangement in analog technique for recognizing speech pauses, which is based on the following method. The speech signal is divided into sections of equal lengths and a voltage value is obtained for each section by means of rectification and by taking the mean value, which voltage value is proportional to the average sound volume of the section. Finally, by taking the mean value during several speech sections a further voltage value is determined, which is proportional to the average loudness of the conversation. By comparing these two mean values it is determined whether a section is associated with a speech pause or not.

In the method of pause recognition no account is inter alia taken of the fact that, for example, unvoiced speech parts result in an almost total power reduction in the speech signal and that the relevant speech sections may therefore erroneously be recognized as speech pauses. Such faulty decisions occur in the prior art method more frequently according as the extent to which noise signals are superposed on the speech signal is greater.

SUMMARY OF THE INVENTION

It is therefore an object of the invention, to provide a method of recognizing pauses in a disturbed speech signal, in which faulty decisions as defined above are avoided. In addition, it must be possible to realize the method with digital means and speech pause recognition must also be possible when the average noise power changes only slowly.

This object is accomplished by means of the steps described in claim 1. The sub-claims describe advantageous embodiments.

The invention will now be further described by way of example with reference to the accompanying Figures.

DESCRIPTION OF THE PREFERRED EMBODIMENT

Figure 1:
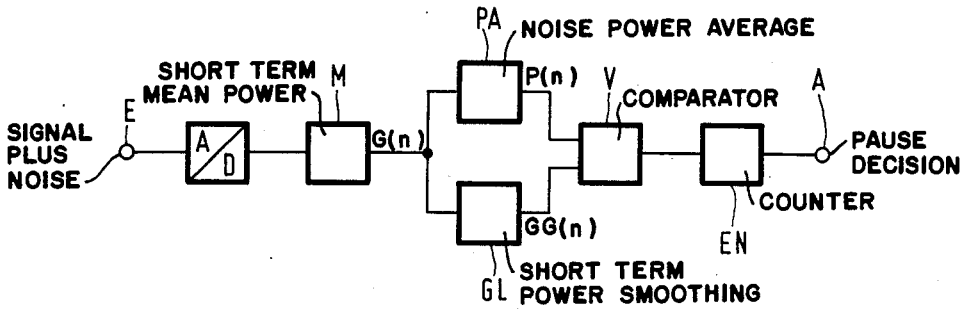
FIG. 1 is a block diagram to explain the method according to the invention.

In the block diagram shown in FIG. 1 sample values x(k), where k represents a natural number and $1/T_o$ represents the sampling frequency, are obtained at sampling instants $kT_o$ by means of an analog-to-digital converter A/D from a disturbed speech signal applied to a terminal E. At all clock instants T(n) which are spaced apart in the time by $mT_o$ the mean value producer M produces a so-called short-time mean value from the amounts of m consecutive sampling values.

$$G(n) = \frac{1}{m} \sum_{\nu=o}^{m-1} |x(mn - \nu)|; \; n = 1, 2, 3, \ldots \text{ etc.}$$

The arithmetic mean from the amounts of the sampling values is used by way of mean value, as this value can be determined with a lower number of components than, for example, the root-mean-square value. Each short-time mean value G(n) is approximately a measure of the average power of the disturbed speech signals considered over a period of time of approximately 100 ms. This information and the sampling frequency also determine the number m of sampling values required to determine one of the short-time mean values G(n). If, for example, the disturbed speech signal is sampled with 10 kHz, then m must be approximately 1000. So each quantity G(1), G(2), . . . is obtained from approximately one thousand consecutive sampling values.

The unit GL of FIG. 1 effects a smoothing operation on the sequence of short-time mean values G(n). Further details about the object and the type and manner of smoothing are given hereinafter.

In parallel with the smoothing operation, an estimate P(n) is determined via the block PA of FIG. 1 for the average noise power, that is to say for the average power of the noise signals. More details of the estimate P(n) will also be given hereinafter. A comparator V in FIG. 1 compares a threshold S which depends on the estimate P(n) to the smoothed short-time mean values GG(n). If the smoothed short-time mean value GG(n) is less than the threshold S, a signal is conveyed to a unit EN. If the unit EN has received such a signal, for example at two consecutive clock instants T(n−1) and T(n) it reports by means of its own specific signal at a terminal A that a speech pause is present.

Figure 2:
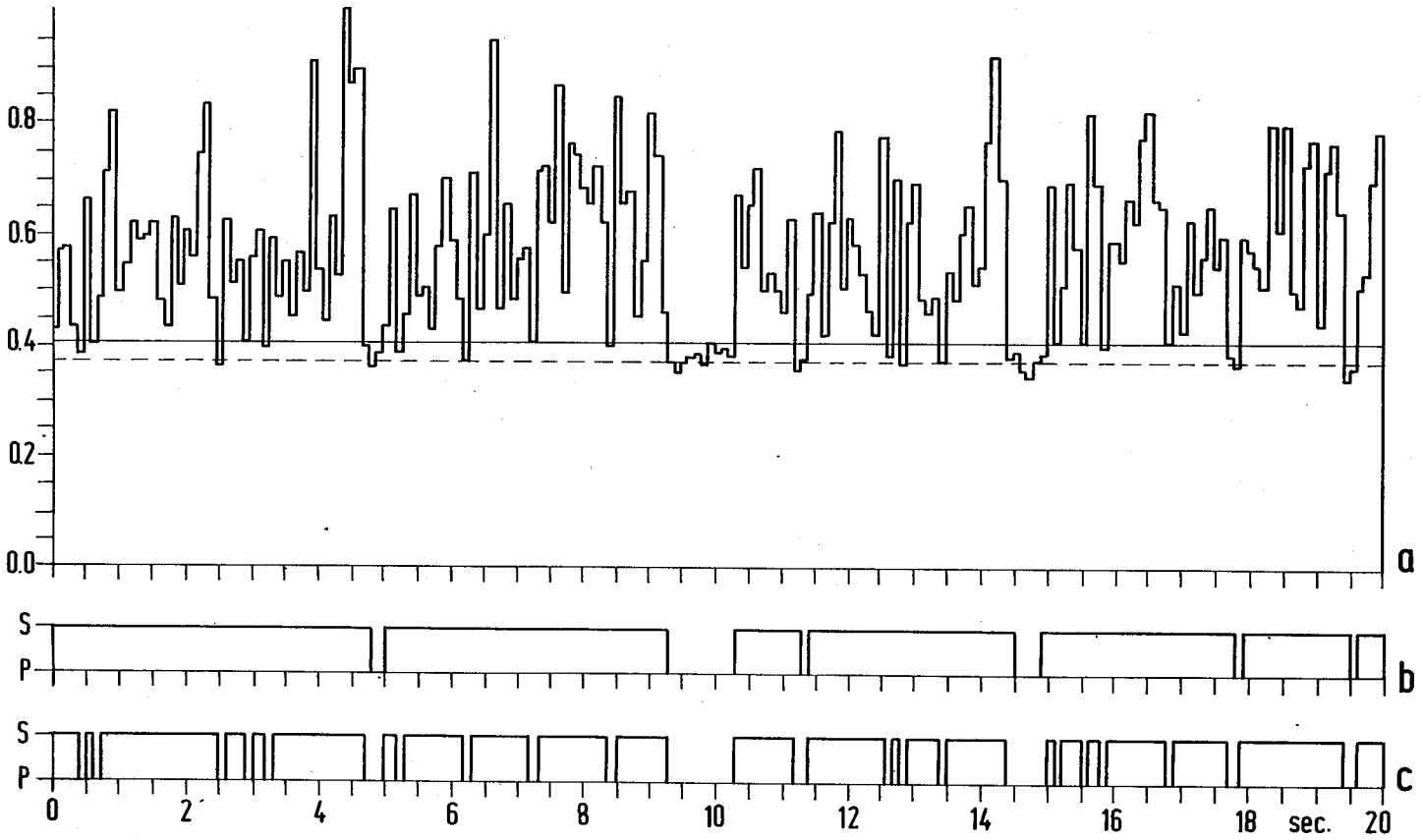
FIGS. 2, 3 and 4 are diagrams to explain the method according to the invention.

The diagram (a) of FIG. 2 shows a possible output signal AM of the mean-value producer M, that is to say a possible sequence of short-time mean values G(1), G(2), . . . . In diagram (a) the output signal AM is standardized such that its absolute maximum assumes the value 1. The amplitude thresholds shown in the drawing relate to the estimate P(n) (lower threshold, broken line) and to the threshold S (upper threshold, solid line). Diagram (b) shows schematically the associated speech signal S with its true pauses P. Should the determination of a pause be based on the fact that the higher amplitude threshold in diagram (a)—this pause determination is shown in diagram c—is fallen short of, then a plurality of faulty decisions would be obtained, as a comparison between the diagrams (b) and (c) shows. Shifting the upper threshold downwards would indeed result in the substantially total power reductions comprised in diagram (c), which are not based on speech pauses not being reported but the information about the length of the pauses would be significantly invalidated.

Therefore, the method according to the invention provides, before it is decided that there is a pause, a smoothing of the output signal AM, again with the aid of a linear digital filter, by means of which a value GG(n) of the smoothed signal is obtained from three consecutive short-time mean values G(n), G(n−1) and G(n−2), or with the aid of a median filter. The value of GG(n) may be ascertained from the formula $$GG(n) = \sum_{i=0}^{2} c_i G(n-1),$$

where $c_0$, $c_1$ and $c_2$ are all greater than or equal to zero and their sum has a value equal to 1.

For the linear filtering operation a filter having the coefficients $\frac{1}{4}$, $\frac{1}{2}$ and $\frac{1}{4}$ was found to be advantageous.

Figure 3:
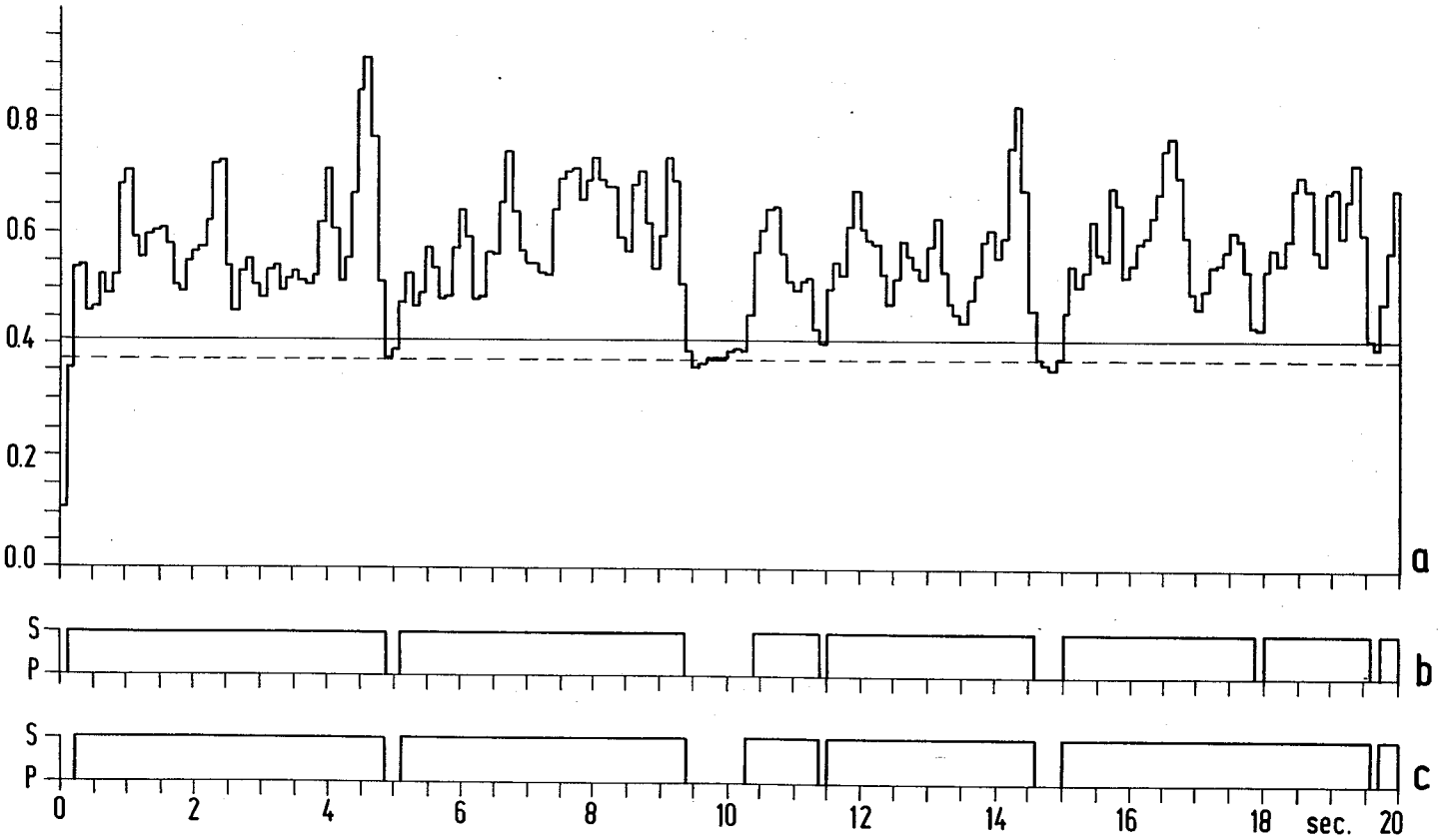

In the median filtering operation, five consecutive short-time mean values G(n) . . . G(n−4), for example, are arranged according to value and then the mean value is read as an output value GG(n) of the filter. Diagram (a) of FIG. 3 shows the aspect of the input signal of the mean-value producer N after smoothing with the aid of a linear digital filter. In diagram (b) the true speech sections and the true pauses in the speech signal are again shown schematically, and diagram (c) shows the speech sections and speech pauses such as they are obtained in analogy with diagram (c) of FIG. 1. Because of the linear smoothing operation, the number of faulty decisions is significantly reduced as can be seen from a comparison between FIG. 2 and FIG. 3. Also when smoothing is effected with the aid of a median filter the number of faulty decisions is reduced—as can be seen from diagram (c) of FIG. 4.

Figure 4:
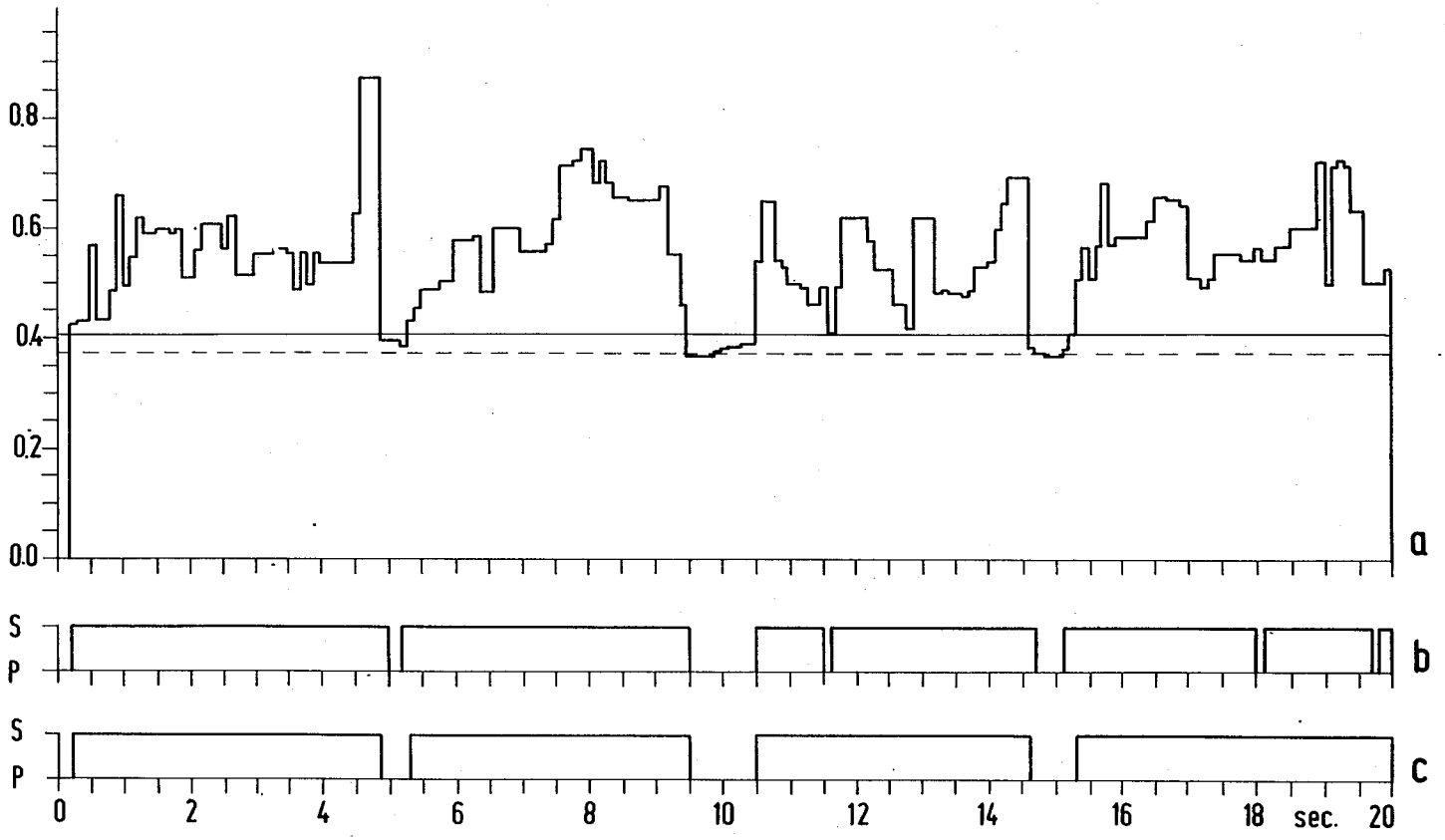

A further measure which prevents shorter substantially total power reductions in the disturbed speech signal from being erroneously considered as pauses, consists in that, for example, a substantially total power reduction is not considered as a speech pause until it has twice fallen short of the higher amplitude threshold in FIGS. 2, 3 or 4.

The amplitude thresholds shown in the FIGS. 2, 3 and 4 are, as already described in the foregoing, produced by the unit PA of FIG. 1, and more specifically the estimate P(n) of the noise power is first determined for each instant T(n). This quantity must be an approximate measure of the average power of the noise signal, the averaging period being in the order of magnitude of one second.

Whereas the estimate P(n) of the noise power during prolonged speech pauses—how these pauses are recognized will be described in greater detail hereinafter—is adjusted to an actual value, the method according to the invention provides good results also when the above-mentioned average power of the noise signal changes only slowly, that is to say when they may be considered to be stationary in a time interval to the order of one or two seconds.

If the instant T(n) is present in a prolonged speech pause, than the estimate P(n) is determined again as a linear combination from the preceding estimate P(n−1) and the short time mean value G(n) in accordance with the equation $$P(n)=(1-\alpha)P(n-1)+\alpha P(n)$$

The value of the constant $\alpha$ occurring in this equation is between 0 and 1. A typical value for $\alpha$ is 0.5. If no prolonged speech pause is present, then the preceding estimate is maintained, that is to say it is assumed that $p(n)=P(n-1)$. A value zero is chosen for the estimate at the very beginning of the method.

To enable the recognition of prolonged speech pauses a continuous check is made whether the difference between two consecutive short-time mean value is, as regards their magnitude, below a threshold D. If, for example, K times consecutively the inequation $$|G(n)-G(n-1)|<D=\gamma G(n)$$

is satisfied, then this circumstance is considered to indicate the presence of a prolonged speech pause and the new estimate P(n) is determined in accordance with the above equation. The threshold D is chosen proportionally to the short-time mean value G(n), so as to obtain the same results when, for example, the level of all the signals is doubled. The proportionality factor $\gamma$ and the number K can experimentally be determined such that the recognition method takes the lowest possible number of faulty decisions. Typical values are K=10 and $\gamma=1.1$.

Another way to obtain the best possible estimate P(n) for a slowly changing noise power consists in increasing at each sampling instant T(n) the estimate P(n−1) already present by a fixed amount c when the estimate P(n−1) is lower than the short-time mean value G(n). So each time the inequation P(n−1)<G(n) is satisfied, it is assumed that $P(n)=P(n-1)+c$.

The constant c can be chosen such that in the event of an unimpeded increase the estimate reaches the overload level in one to two seconds. If on the other hand the estimate P(n−1) already present is higher than the instantaneous short-time mean value G(n), then the new estimate P(n) is reduced with respect to the estimate present, more specifically in accordance with the equation $$P(n)=(1-\beta)P(n-1)+\beta G(n),$$

which represents the new estimate as a linear combination of the preceding estimate and the instantaneous short-time mean value G(n). A reduction in the estimate can be recognized most distinctly when a value one is chosen for the constant $\beta$. Then, namely, it is obtained that $P(n)=G(n)<P(n-1)$. However, values around 0.5 have been found to be more advantageous for the constant $\beta$.

The threshold S which is used to decide whether there is a pause or not is proportional to the estimate P(n). Typical for the relationship between the threshold S and the estimate P(n) is the equation S=1.1 P(n).

Thus, there is described one embodiment of the invention for recognizing speech pauses in a speech signal. Those skilled in the art will recognize yet other embodiments defined more particularly by the claims which follow.

What is claimed is:

1. Method for generating a speech pause signal indicating a speech pause in an analog speech signal having noise signals superimposed thereon, comprising the steps of:

generating a clock signal T(n) at predetermined clock instants;

sampling said speech signal at a plurality of sampling instants between sequential ones of said clock instants, thereby creating a plurality of sampling value signals between every two sequential clock instants;

filtering said sampling value signals to generate a short-time mean value signal representing the average value thereof at each of said clock instants;

generating a series of estimated noise power signals, each at one of said clock instants, each at least in part varying in dependence on the corresponding one of said short-time mean value signals;

filtering said short-time mean value signals thereby generating a smoothed mean value signal;

generating a threshold signal varying in dependence on said estimated noise power signal at each of said clock instants comprising combining said short-time mean value signal and a previous estimated noise power signal computed at the immediately preceding one of said clock instants;

at each of said clock instants, comparing said smoothed mean value signal to said threshold signal; and generating said speech pause signal when said smoothed mean value signal is less than said threshold signal.

2. A method as set forth in claim 1, wherein said step of generating said pause signal comprises generating said pause signal only when said smoothed mean value signal is less than said threshold signal at a preselected number of consecutive clock instants.

3. A method as set forth in claim 2, wherein said step of filtering said sample value signals comprises squaring each of said sample value signals, thereby creating squared value signals, and filtering said square value signals to generate said short-time mean value signal.

4. A method as set forth in claim 1, wherein said combining step comprises adding a first predetermined fraction of said short-time mean value signal to a second predetermined fraction of said previous estimated noise power signal, the sum of said first predetermined fraction and second predetermined fraction equalling unity.

5. A method as set forth in claim 1, further comprising the step of subtracting short-time mean value signals at sequential ones of said clock instants from each other and generating a difference signal corresponding to the difference therebetween, generating a second threshold signal, comparing said difference signal to said second threshold signal and generating a first control signal when said difference signal is less than said second threshold signal, combining said previously generated estimated noise power signal and said short-time mean value signal to generate said estimated noise power signal when said difference signal is less than said second threshold signal, and generating an estimated noise power signal equal to said preceding estimated noise power signal when said difference signal exceeds said second threshold signal.

6. A method as set forth in claim 4, wherein said step of combining said short-time mean value signal and said previous one of said estimated noise power signals is carried out only when said short-time mean value signal is below said second threshold signal for a predetermined number K of consecutive preceding clock instants.

7. A method as set forth in claim 1, wherein said step of generating a smoothed mean value signal comprises multiplying said short-time mean value signal by a predetermined constant $c_1$, the immediately preceding one of said short-time mean value signals by a second predetermined constant $c_2$, and the next preceding one of said short-time mean value signals by a third predetermined constant $c_3$, and adding the so-multiplied value signals to one another; and wherein $c_1+c_2+c_3=1$.

8. A method as set forth in claim 5, wherein said second threshold signal is proportional to said short-time mean value signal.

* * * * *